United States Patent [19]

Carrozo

[11] 4,111,341

[45] Sep. 5, 1978

[54] NEEDLEPOINT, EMBROIDERY AND CREWEL CARRYING CASE

[76] Inventor: Camelita R.Carrozo, 11990 S. Boulder Rd., #178, Lafayette, Colo. 80026

[21] Appl. No.: 791,421

[22] Filed: Apr. 27, 1977

[51] Int. Cl.[2] ..... A41H 31/00

[52] U.S. Cl. ..... 223/106; 40/10 R; 40/19.5

[58] Field of Search ..... 223/106, 107; 242/137, 242/137.1; 40/19.5, 10 R, 10 D; 211/106; 248/307; 312/234.1, 234.2, 234.3, 234.4; 190/52, 60

[56] References Cited

U.S. PATENT DOCUMENTS

| | | | |
|---|---|---|---|
| 949,485 | 2/1910 | Karay | 223/107 |
| 1,491,807 | 4/1924 | McLinn | 190/52 X |
| 1,509,854 | 9/1924 | Vance | 40/19.5 |
| 1,813,030 | 7/1931 | Davenport | 40/19.5 |
| 2,923,451 | 2/1960 | Hokerk | 223/107 X |
| 3,145,646 | 8/1964 | Levy | 223/106 X |
| 3,337,977 | 8/1967 | Sobesky | 40/10 R |

*Primary Examiner*—George H. Krizmanich
*Attorney, Agent, or Firm*—Richard N. Miller; Murray M. Grill; Herbert S. Sylvester

[57] ABSTRACT

A needlepoint, embroidery and crewel carrying case in which all of the necessary and essential items for such work can be conveniently carried and stored. This type of work involves the use of a relatively wide variety of different colored and perhaps different types of yarns and yarn skeins and further can involve a number of different shades of the various different colors. The carrying case according to the present invention is particularly suited for use with this type of work in that the means within the case for separating the yarn skeins and separately supporting those various skeins includes pockets or recesses designed to hold skein identifications tabs. This allows for the more accurate selection of the proper yarn for use according to the numbered pattern being used and also aids in maintaining separation between various yarn skeins within the carrying case.

9 Claims, 4 Drawing Figures

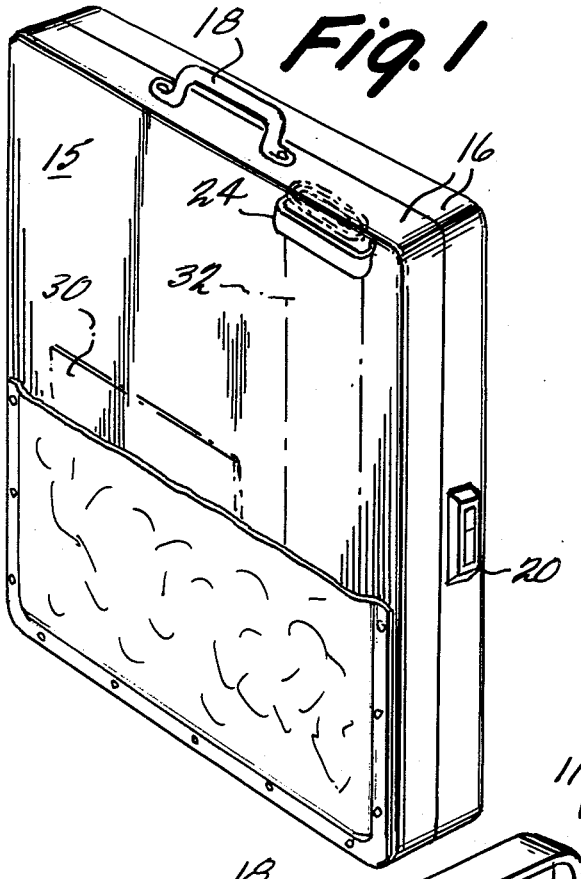
Fig. 1
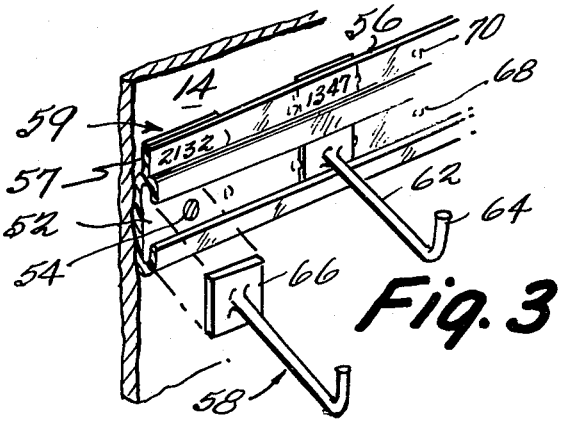
Fig. 3
Fig. 4
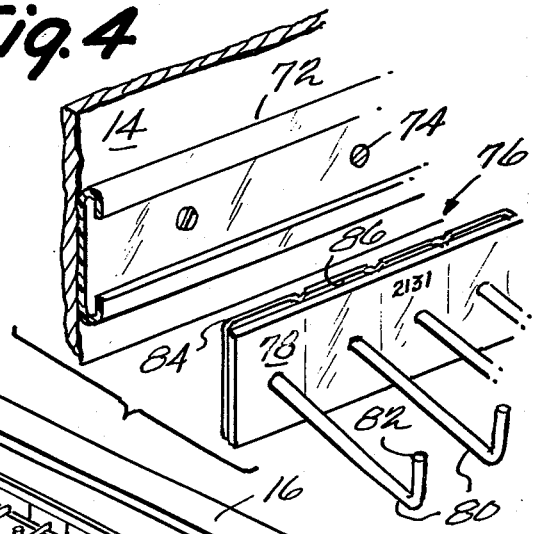
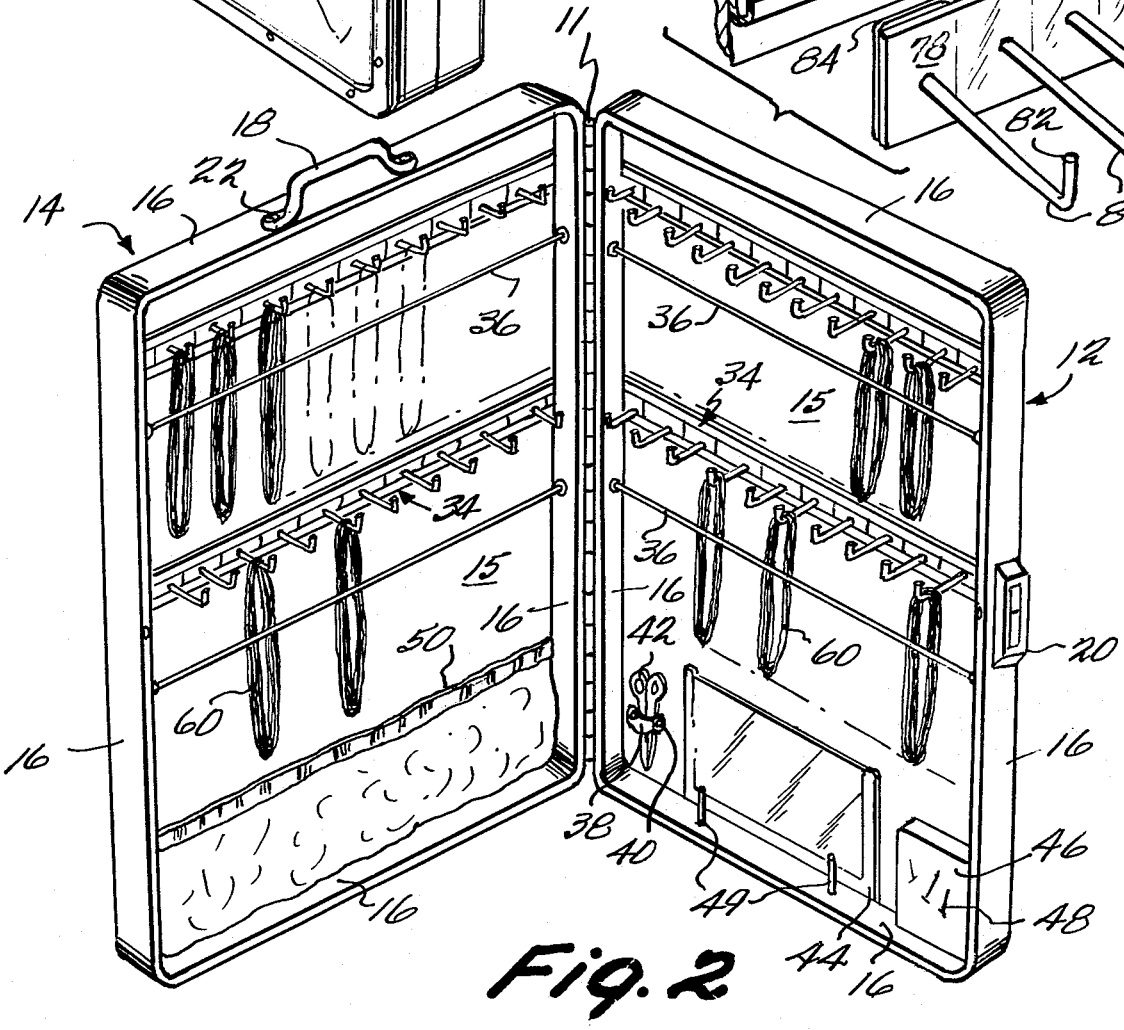
Fig. 2

NEEDLEPOINT, EMBROIDERY AND CREWEL CARRYING CASE

BACKGROUND OF THE INVENTION

Needlepoint, embroidery and crewel type of work of course involves the use of a number of materials. These include a fairly wide variety of different colors and shades of yarns, usually in the form of short, small skeins, needles, scissors, the pattern or patterns being used and the base material or textile substrate into which the yarns are being placed according to the pattern. In addition, since it is desirable when traveling to carry extra quantities of yarn to prevent running out, a number of extra large storage pockets are also provided for holding this extra yarn so that needlepoint, crewel or embroidery work could continue.

Containers for carrying sewing articles have been known in the past. Exemplary of such devices are the following U.S. Pat. Nos. 1,573,330, Smith, Birkholz, 2,261,216, Schreyer, 2,398,256.

Smith shows a frame assembly made of two frame members hingedly connected together which are adapted to open and close one with aspect to the other. The device is provided with pockets in which to hold garments being sewed. The frame member is enclosed by means of an outer textile cover and on the interior is provided with a shelf and support posts or upright pins for holding spools of thread. Also there are a plurality of hooks on which scissors or other articles may be hung.

Birkholz also discloses a pair of frame members which are hingedly connected together so that the two members can be opened and closed. As was true in the Smith arrangement, the sewing cabinet disclosed by Birkholz is used to hold items being sewed and to keep sewing materials within convenient reach of the sewer as sewing progresses. The cabinet is provided with a series of trays for supporting scissors, pins, needles, buttons, etc., and also upstanding pins for holding spools of thread and internal pockets for holding the material being sewed.

The sewing cabinet disclosed by Schreyer also is comprised of two hingedly connected frame assemblies which are provided with interior pockets and vertical posts for supporting a plurality of spools of yarn. In addition, pockets are also provided for holding knitting needles and other sewing or knitting tools. In addition, this patent discusses the use of the upright, vertical support posts as being capable of holding a relatively long skein of yarn as it is being wound into a ball for future use.

Other examples of sewing or thread cabinets are exemplified by U.S. Pat. Nos. 2,679,341, 2,852,172, 3,321,117 and 3,322,310. These show various arrangements employing vertical posts for supporting spools of yarn and sewing boxes which are adapted to hold thread spools and also contain means for holding applied or necessary equipment which will be used for sewing purposes.

None of these prior art devices, however, are designed specifically for holding a wide variety of relatively short skeins of yarn as are used in needlepoint, embroidery and crewel work.

Further, none of these prior art devices provide means for keeping a plurality of such small skeins separated and held in place, nor any means for providing an easy method for identifying or determining which color yarn to use.

The patterns employed in needlepoint and embroidery work are not written in terms of yarn colors, but rather, are comprised of a graph-type grid comprised of a plurality of small squares. Symbols or numbers are placed in these squares in a manner corresponding to the pattern with each different number symbol corresponding to a particular shade or color yarn. Even with simple patterns, the number of colors or shades used sometimes is as great as 25 or more. The problem then becomes one of easily finding the correctly numbered yarn skein to correspond with the requirements set forth in the pattern so that the needlepoint or embroidery work can proceed in a quick and a relatively easy fashion. If one were to simply have pockets for holding the various skeins of yarn, finding the correct skein could involve a great deal of hunting and searching through each pocket to find the correct number. In addition, skeins, when purchased, are usually identified by a number sleeve which, as the skein is reduced in size becomes only loosely held on the skein. If the skeins are allowed to remain loose in pockets as the size of the skeins is reduced, the likelihood of the identifying sleeves being removed increases. Thereafter, it is oftentimes difficult to distinguish correctly between different hues of particular colors especially where a number of hues which are close together are being used in the same pattern.

The present invention solves such problems and provides a ready and convenient means for maintaining separation between the yarn and also for providing a quick and easy means for locating the correctly numbered yarn pursuant to pattern requirements.

Thus, the primary object of the present invention is to provide an organizing and carrying cabinet particularly suited for holding needlepoint, embroidery and crewel materials and to provide, in addition, means for positively separating all of the various small skeins of yarn and other equipment necessary for such work as well as providing means for positively identifying each skein of yarn so as to simplify the process of finding the correct yarn according to pattern requirements.

Other objects and advantages will become apparent as the description of the preferred embodiments of the present invention are described in detail by reference to the accompanying drawings wherein like parts are designated by like reference numerals in several views. The drawings are comprised of:

FIG. 1, a perspective view of the carrying case in a closed condition;

FIG. 2 is a perspective view of the carrying case according to the present invention in an open condition;

FIG. 3 is a fragmentary perspective view of a portion of one embodiment of the yarn-holding rack;

FIG. 4 is a fragmentary perspective view of a second embodiment of the yarn-holding rack.

Referring now to FIGS. 1 and 2, the carrying case is generally indicated at 10 and is comprised of two sections, 12 and 14, respectively, which are connected together by means of hinge 11. Each case section, 12 and 14, are constructed so as to have main or outer wall member 15 and marginal sidewalls 16 so that when the case is closed, as in FIG. 1, the marginal sidewalls 16 of each section will respectively be in contact with a corresponding sidewall of the other case section. The case sections 12 and 14 are preferably constructed from a moldable plastic and are of a one-piece design. However, these case sections can equally as well be constructed from wood, metal or any other convenient material, the only requirement being that the case should be relatively sturdy so as to protect the contents therein.

The case is provided with a handle 18 and a latch assembly generally indicated at 20. The latch assembly 20 can be comprised of any conventional closure such as those used for suitcases, or for that matter it could also be comprised of a latch and catch arrangement. The only essential requirement is that the latch assembly 20 be sufficient to retain the case sections 12 and 14 in a closed condition. Further, the latch assembly 20 can also have incorporated therewith a lock for securing the latch when the case is closed.

Handle 18 is shown being attached to case section 14 by means of screws 22. However, it should be understood that if case section 14 was formed from moldable plastic, handle 18 could be an integral portion of that molded construction and an integral part of the case assembly as opposed to being attached by screws 22. The handle 18 could also take other forms such as a hand or shoulder strap.

As shown in FIG. 1, the exterior surface of case section 14 is provided with a retaining strap 24 near the upper portion of the case and an outer pocket 26 on the lower portion thereof which preferably extends across the full width of case section 14. This pocket 26 can either be an integral part of the one-piece case section structure if that structure is molded from a themoplastic type material or can comprise a sheet of material, preferably a tough, rugged material, which can be attached to the case section 14 in any convenient manner, as for example by means of tacks 28 or a subsequent separate heat sealing process. It should be understood, however, that the material forming pocket 26 could be attached by any other convenient means. The pocket 26 can serve to hold the pattern being used indicated in phantom as at 30. The pocket 26 also can cooperate with the retaining strap 24 for holding the base fabric onto which the pattern is being placed and which can be rolled up in a tubular form as indicated in phantom at 32.

Turning now to FIG. 2, the interior of the carrying case 10 is provided with a plurality of yarn rack assemblies, generally indicated at 34. Associated with each of the yarn rack assemblies is an elastic retaining strap 36 for aiding in holding the relatively small skeins of yarn in the desired predetermined position and for also maintaining separation between the various skeins by preventing them from moving or swinging. On the interior and lower portion of case section 12 is a retaining strap 38 mounted thereto by mounting pins 40. The mounting pins 40 could alternatively be replaced by snaps or any other convenient method for mounting the retaining strap 38. As shown, the retaining strap 38 is useful for holding a pair of scissors 42. Also provided in the lower portion of case section 12 is a pocket 44 preferably constructed from clear plastic which can be used for purposes of holding smaller patterns or for holding an index to the numbered skeins of yarn being used for any particular pattern. A needle holder 46 is also located in the lower part of case section 12 and preferably made of some soft material such as foam rubber for holding needles 48. Further, a pair of spaced apart pegs 49 are mounted on the bottom of case section 12. Pegs 49 can be used to wind yarn into skeins of a convenient size if skeins of such size are not available.

As shown in FIG. 2, an additional interior pocket 50 can also be provided in the lower portion of case section 14 which would be useful for storing any number of items such as additional skeins of yarn, patterns, base material for needlepoint, embroidery and crewel work, instruction booklets, etc.

Turning now to FIGS. 3 and 4, two embodiments are set forth for yarn rack assemblies 34. Turning first to FIG. 3, a fragmentary portion of case section 14 is shown on which a supporting rack 52 having a generally C-shaped cross section is mounted. Supporting rack 52 can be attached to case section 14 as, for example, by screws 54, however, any other convenient means could also be used. The supporting rack 52 is provided with an upstanding rib 56 which when the supporting rack 52 is attached to case section 14 will produce a slot or opening generally indicated at 57 between rib 56 and the interior surface of the wall forming case section 14. This slot or opening 57 is preferably of a width which is sufficient to receive the sleeve which normally comes around skeins of yarn and which has been folded so as to leave the identification number exposed, such a folded sleeve or identification tab is shown as being inserted and is indicated at 59. After the sleeve is folded in that manner, it can easily be inserted into the opening formed by upstanding rib 56. Further, since the supporting rack 52 as well as rib 56 is preferably made from a clear plastic, the identification number appearing on the sleeve will be visible through rib 56.

Still referring to FIG. 3, individual hooks, generally indicated at 58, are provided for holding the skeins of yarn indicated at 60 in FIG. 2. Each of the hooks 58 is provided with a shank portion 62 having an upturned end 64. The shank 62 is molded to a rear support plate 66 which is sized to allow for its insertion within supporting rack 52. Preferably, individual hooks 58 can be inserted into supporting rack 52 by inserting the upper portion of the support plate 52 by inserting the upper portion of the support plate 66 into the upper portion of the C-shaped supporting rack with the height of the support plate 66 being such that the bottom will then be able to clear the upturned bottom part of supporting rack 52. Thereafter, the bottom portion of support plate 66 can be allowed to drop into the space defined by the curved bottom portion of supporting rack 52. The width of the opening in the C-shaped supporting rack 52 is preferably less than the height of the support plate so that once the support plate 66 has been inserted it cannot rotate out of the supporting rack but will be held therein by the C-shaped structure. In order to prevent individual hooks 58 from moving within supporting rack 52 after they have been inserted therein, a plurality of retaining bumps 68 are provided on the rear wall of supporting rack 52 and are spaced apart a distance approximately equal to the width of support plate 66. Similar retaining members 70 can be formed on the rear surface of upstanding rib 56 for purposes of preventing lateral movement of identification tabs 59 as is shown in FIG. 3.

Turning now to FIG. 4, a second embodiment for the yarn rack assembly 34 is set forth and again only a fragmentary portion of case section 14 is shown for clarity purposes. As was the case with the first embodiment shown in FIG. 3, a generally C-shaped supporting rack 72 is attached to case section 14 for example by screws 74 although other conventional mounting means could likewise be used. A hook assembly, generally indicated at 76, is comprised of a one-piece structure including a one-piece support plate 78, which is also preferably made from a clear plastic material. Mounted to the front of support plate 78 are a plurality of hooks 80 which are provided on their exterior outer ends with upturned portions 82. Preferably the support plate 78 and hooks 80 are molded as a one-piece unit but it should be understood that it is only essential the hooks 80 be securely mounted thereto. A plastic sheet 84 is heat sealed onto the rear of support plate 78 at spaced apart locations so as to form a plurality of pockets, generally indicated at 86, with a number of pockets being equal to the number of hooks 80 mounted thereon. Again, the width of pockets 86 should be sufficient to receive the folded skein sleeves or identification tabs 59. Since the support plate 78 is preferably made from a transparent plastic material, the identification tabs 59 and the numbers thereon will be visible through support plate 78 so as to correctly identify the yarn skein held on each respective hook 80.

The method of inserting the hook assembly 76 into the generally C-shaped supporting rack 72 is similar to the method of inserting the hooks and discussed with respect to FIG. 3 above, the only difference being that the entire row of hooks and the support plate 78 would be inserted together as a one-piece unit.

While the present invention has been described in connection with the preferred embodiments, it is to be understood that the invention is not to be limited to these disclosed embodiments but on the contrary, it is intended to cover other various modifications and equivalent arrangements which are properly includable within the spirit and scope of the appended claims.

What I claim is:

1. A needlepoint, embroidery and crewel carrying case for conveniently carrying equipment and materials necessary for such work comprising a pair of recessed case members each having marginal sidewalls and an outer wall, said case members being hinged together so as to be closable so as to bring the marginal sidewalls, respectively, into engagement thereby forming a closed case;

said case further including on the interior thereof a plurality of hook assemblies each including a plurality of spaced apart, interiorly extending hooks for holding skeins of yarn in a separated condition each of said hook assemblies including a supporting bracket mounted to the interior of said case members, and holding means to which said hooks are attached for detachably holding said hooks on said supporting bracket, and said supporting bracket comprising an elongated, generally C-shaped bracket extending substantially across the width of said case member;

means defining a recess provided adjacent each of said hooks for receiving therein tabs for identifying the skeins of yarn, said recess means being formed from transparent material so that the identification tabs retained therein are visible therethrough, and said recess means further comprising an elongated rib secured to the exterior of and extending vertically away from said supporting bracket and spaced from the interior wall of said case member so as to define a space therebetween, the side of said rib directed toward the interior wall of said case member being provided with a plurality of spaced apart projections so as to define a plurality of separated recesses therebetween into which the identification tabs can be retained said projections preventing the lateral movement of such tabs; and said carrying case further including at least one pocket means for holding equipment necessarily involved in needlepoint, embroidery and crewel type of work.

2. A needlepoint, embroidery and crewel carrying case for conveniently carrying equipment and materials necessary for such work comprising a pair of recessed case members each having marginal sidewalls and an outer wall, said case members being hinged together so as to be closable so as to bring the marginal sidewalls into engagement thereby forming a closed case, a plurality of hook means disposed on the interior of said case for holding skeins of yarn in spaced positions, and hook means including a plurality of spaced apart hooks disposed in the same row, extending from one of said case membes, indicia associated with each hook for identifying the skeins of yarn supported thereby, and strap means associated with said plurality of hooks and extending generally parallel to said row for restricting movement of skeins of yarn supported by said hooks in said row, said strap means being spaced from said hooks a distance less then the effective length of skeins supported by said hooks, and said skeins being accessible on either side of said strap means.

3. A case as recited in claim 2 wherein said strap means comprise a resilient strap having two spaced end portions thereof attached to spaced portions of said one case member.

4. A case as recited in claim 3 wherein said strap is of elastic material.

5. A case as recited in claim 3 whrein each of said hooks comprises a shank portion extending outwardly from said one case member generally perpendicular thereto, and has an upturned end.

6. A case as recited in claim 2 wherein said hook means comprise a plurality of hooks disposed in a plurality of rows, at least one row associated with each case member, and strap means associated with each row.

7. A case as recited in claim 2 further comprising means for facilitating winding of yarn into skeins of a convenient size for disposition in said case, said means comprising a pair of pegs upstanding from a planar surface of said case interior, said pegs spaced apart a distance greater than the distance between a hook and its associated strap means.

8. A needlepoint, embroidery and crewel carrying case for conveniently carrying equipment and materials necessary for such work comprising a pair of recessed case members each having marginal sidewalls and an outer wall, said case members being hinged together so as to be closable so as to bring the marginal sidewalls, respectively, into engagement thereby forming a closed case;

a plurality of hook assemblies on the case interior, each including a plurality of spaced apart, interiorly extending hooks for holding skeins of yarn in a separated condition, each of said hook assemblies including a supporting bracket mounted to the interior of said case members, and holding means to which said hooks are attached for detachably holding said hooks on said supporting bracket, and wherein said holding means comprises an elongated holding plate having a plurality of hooks attached thereto;

means defining a recess provided adjacent each of said hooks for receiving therein tabs for identifying the skeins of yarn, said recess means being formed from transparent material so that the identification tabs retained therein are visible therethrough, and recess means further comprising a sheet of formable material secured to said elongated holding plate at spaced apart locations so as to define a plurality of pockets therealong into which the identification tabs can be inserted; and said carrying case further including at least one pocket means for holding equipment necessarily involved in needlepoint, embroidery and crewel type of work.

9. A needlepoint, embroidery and crewel carrying case for conveniently carrying equipment and materials necessary for such work comprising a pair of recessed case members each having marginal sidewalls and an outer wall, said case members being hinged together so as to be closable so as to bring the marginal sidewalls, respectively, into engagement thereby forming a closed case;

said case further including on the interior thereof a plurality of hook assemblies each including a plurality of spaced apart, interiorly extending hooks for holding skeins of yarn in a separated condition;

means defining a recess provided adjacent each of said hooks for receiving therein tabs for identifying the skeins of yarn, said recess means being formed from transparent material so that the identification tabs retained therein are visible therethrough;

at least one pocket means for holding equipment necessarily involved in needlepoint, embroidery and crewel type of work; and exterior pocket means mounted on the exterior wall of at least one of said case members and retaining strap means mounted between said exterior pocket means and the top of said carrying case for cooperating with at least a portion of said exterior pocket means to retain elongated pieces of needlepoint, embroidery or crewel materials.

* * * * *

UNITED STATES PATENT AND TRADEMARK OFFICE

CERTIFICATE OF CORRECTION

PATENT NO. : 4,111,341

DATED : September 5, 1978

INVENTOR(S) : Carmelita Carrozo

It is certified that error appears in the above-identified patent and that said Letters Patent are hereby corrected as shown below:

Cover Page, at "[76] Inventor:", delete "Camelita" and insert -- Carmelita -- therefor, as the inventor's name.

Signed and Sealed this

*Third* Day of *April 1979*

[SEAL]

*Attest:*

RUTH C. MASON
*Attesting Officer*

DONALD W. BANNER
*Commissioner of Patents and Trademarks*